United States Patent [19]

Satake

[11] Patent Number: 4,700,622

[45] Date of Patent: Oct. 20, 1987

[54] APPARATUS FOR COMPRESSING AND SOLIDIFYING FIBROUS MATERIALS OF PLANTS

[75] Inventor: Toshihiko Satake, Higashihiroshima, Japan

[73] Assignee: Satake Engineering Co., Ltd., Tokyo, Japan

[21] Appl. No.: 898,123

[22] Filed: Aug. 19, 1986

[30] Foreign Application Priority Data

Aug. 20, 1985 [JP] Japan ..... 60-183582

[51] Int. Cl.[4] ..... B30B 3/02; B30B 15/30; B30B 15/34

[52] U.S. Cl. ..... 100/45; 100/50; 100/70 A; 100/93 S; 100/99

[58] Field of Search ..... 100/38, 41, 45, 50, 100/70 A, 93 S

[56] References Cited

U.S. PATENT DOCUMENTS

| | | | |
|---|---|---|---|
| 2,817,287 | 12/1957 | Onarheim et al. | 100/50 |
| 3,230,902 | 1/1966 | Grimm et al. | 100/93 S |
| 3,320,905 | 5/1967 | Urschel | 100/45 X |
| 3,354,504 | 11/1967 | Lehner | 100/93 S X |
| 3,939,763 | 2/1976 | Sato | 100/93 S |
| 3,973,922 | 8/1976 | Williams | 100/93 S X |
| 4,157,643 | 6/1979 | White | 100/50 X |

FOREIGN PATENT DOCUMENTS

| | | | |
|---|---|---|---|
| 680908 | 9/1979 | U.S.S.R. | 100/45 |
| 685517 | 9/1979 | U.S.S.R. | 100/45 |

*Primary Examiner*—Wm. Carter Reynolds

*Attorney, Agent, or Firm*—Henry Sternberg; Bert J. Lewen

[57] ABSTRACT

An apparatus for compressing and heating a material to be treated, i.e., fibrous materials of plants such as true grasses or the like, changing the quality of the material, and solidifying the same. The material to be treated is delivered by a rotatable screw into and through a quality-changing chamber. During the passage of the material through the quality-changing chamber, the material is heated by a heating device. During the passage of the material through the quality-changing chamber, the material has its tissues destroyed, is softened, is compacted, and is solidified due to the compression by the screw and the heating by the heating device. A sensor senses a load applied to a motor and/or the temperature of the material being treated within the quality-changing chamber. A control system responds to a signal or signals from the sensor to control the load and/or the temperature.

11 Claims, 5 Drawing Figures

APPARATUS FOR COMPRESSING AND SOLIDIFYING FIBROUS MATERIALS OF PLANTS

BACKGROUND OF THE INVENTION

The present invention relates to an apparatus for compressing and heating a material to be treated, i.e., fibrous materials of plants such as, for example, true grasses or the like, changing the quality of the material to be treated, and solidifying the same and, more particularly, to a control system for the apparatus which enables such treatments to be carried out in a continuous and stable manner.

Heretofore, the presence of large amounts of silicates in the stems, branches and leaves as well as the outer covering of seeds of true grasses, particularly in the husks, has prevented these materials from being utilized as fodder for cattle, horses and sheep and fertilizers for plants. The fact is that the husks produced in large volumes by paddy huskers at the grain conditioning stage are dumped and piled out of doors. Since the husks do not undergo decomposition, it is impossible to make effective use of the land where the husks are dumped, and there is a risk of occurrence of fire. It is generally considered a best solution to the problem to artificially or unnaturally burn the husks. However, to burn the husks in large volumes would give rise to the problem of air pollution with smoke and dust.

Japanese Patent Publication No. 57-31943 discloses a method of processing a material to be treated such as outer covering of seeds, stems, branches and leaves of true grasses containing large amounts of silicates. The method consists in feeding the material to be treated into a space which is in the form of a spiral at its inner or outer surface and which has a cross-sectional area successively decreasing, destroying the molecular structure of the material under a pressure of 1–100 tons per 1 $cm^2$ and at a temperature of 150–600° C., and solidifying the material to be treated. The solidified material can be used as a fuel without any further processing or can be crushed into smaller particles for use as industrial material or as fodder for cattle, horses and sheep. However, no apparatus has ever been developed which is capable of satisfactorily carrying into practice the method disclosed in the Japanese patent publication referred to above.

OBJECT AND SUMMARY OF THE INVENTION

This invention has as its object the provision of an apparatus for compressing and heating a material to be treated, i.e., fibrous materials of plants, changing the quality of the material to be treated, and solidifying the same, which apparatus is capable of carrying out such treatments to be carried out continuously in a stable manner.

According to the invention, there is provided an apparatus for compressing and heating a material to be treated, i.e., fibrous materials of plants, changing the quality of the material, and solidifying the same, the apparatus comprising:

a rotatable screw having an upstream and a downstream end;

tubular forming means disposed around the screw and cooperating with the same to define therebetween a quality-changing chamber;

feeding means for feeding the material to be treated to the upstream end of the screw;

heating means associated with the tubular forming means to heat the material to be treated within the quality-changing chamber so as to maintain the temperature of the material within the quality-changing chamber at a predetermined value during the operation of the apparatus;

drive means drivingly connected to the screw to rotate the same to deliver the material fed from the feeding means, to the quality-changing chamber while compressing the material, to cause the material to be delivered through the quality-changing chamber toward the downstream end of the screw while the material is heated by the heating means, to thereby allow the material to be gradually changed in quality and solidified due to the compression by the screw and the heating by the heating means during the passage of the material through the quality-changing chamber;

sensor means for sensing a parameter varying depending upon a load applied to the screw to generate a signal;

control means responsive to the signal from the sensor means to generate an operation signal; and regulating means operative in response to the operation signal from the control means to regulate the flow rate of the material to be treated fed from the feeding means to the upstream end of the screw.

According to the present invention, there is further provided an apparatus for compressing and heating a material to be treated, i.e., fibrous materials of plants, changing the quality of the material, and solidifying the same, the apparatus comprising:

a rotatable screw having an upstream and a downstream end;

tubular forming means disposed around the screw and cooperating with the same to define therebetween a quality-changing chamber;

feeding means for feeding the material to be treated to the upstream end of the screw;

heating means having a variable heat capacity and associated with the tubular forming means for heating the material to be treated within the quality-changing chamber so as to maintain the temperature of the material within the quality-changing chamber at a predetermined value during the operation of the apparatus;

drive means drivingly connected to the screw to rotate the same to deliver the material fed from the feeding means, to the quality-changing chamber while compressing the material, to cause the material to be delivered through the quality-changing chamber toward the downstream end of the screw while the material is heated by the heating means, to thereby allow the material to be gradually changed in quality and solidified due to the compression by the screw and the heating by the heating means during the passage of the material through the quality-changing chamber;

sensor means for sensing a parameter varying depending upon the temperature of the material being treated within the quality-changing chamber to generate a signal;

control means responsive to the signal from the sensor means to generate an operation signal; and means operative in response to the operation signal from the control means to adjust the heat capacity of the heating means.

DETAILED DESCRIPTION

Figure 1:
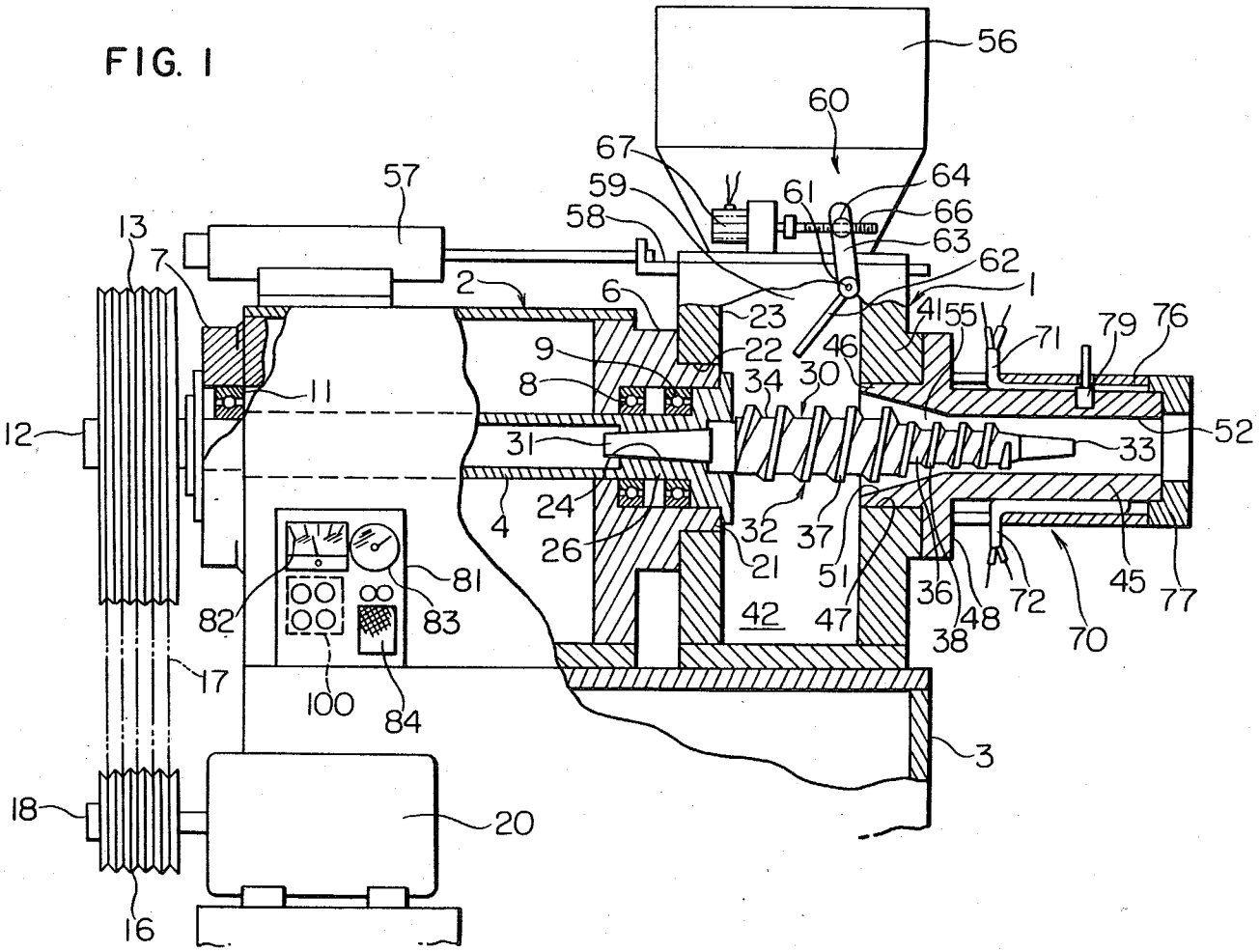
FIG. 1 is a partially cross-sectional, side elevational view showing an apparatus in accordance with an embodiment of the invention.

Embodiments of the invention will now be described by referring to the accompanying drawings. Throughout the drawings, like reference characters are used to designate like or similar parts and components.

Figure 2:
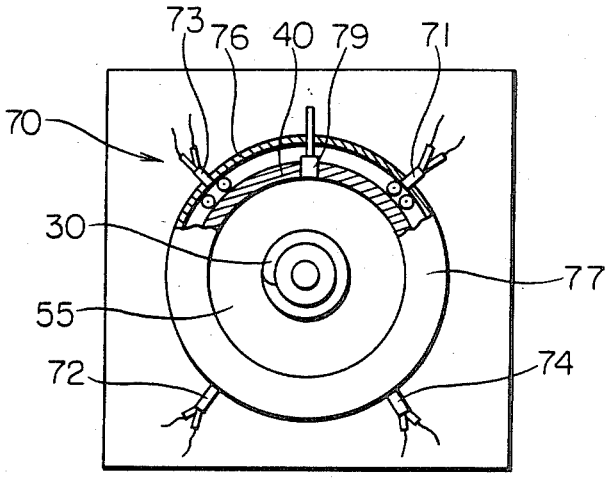
FIG. 2 is a fragmental, partially broken-away, front elevational view, in enlarged scale, showing the apparatus illustrated in FIG. 1.
Figure 3:
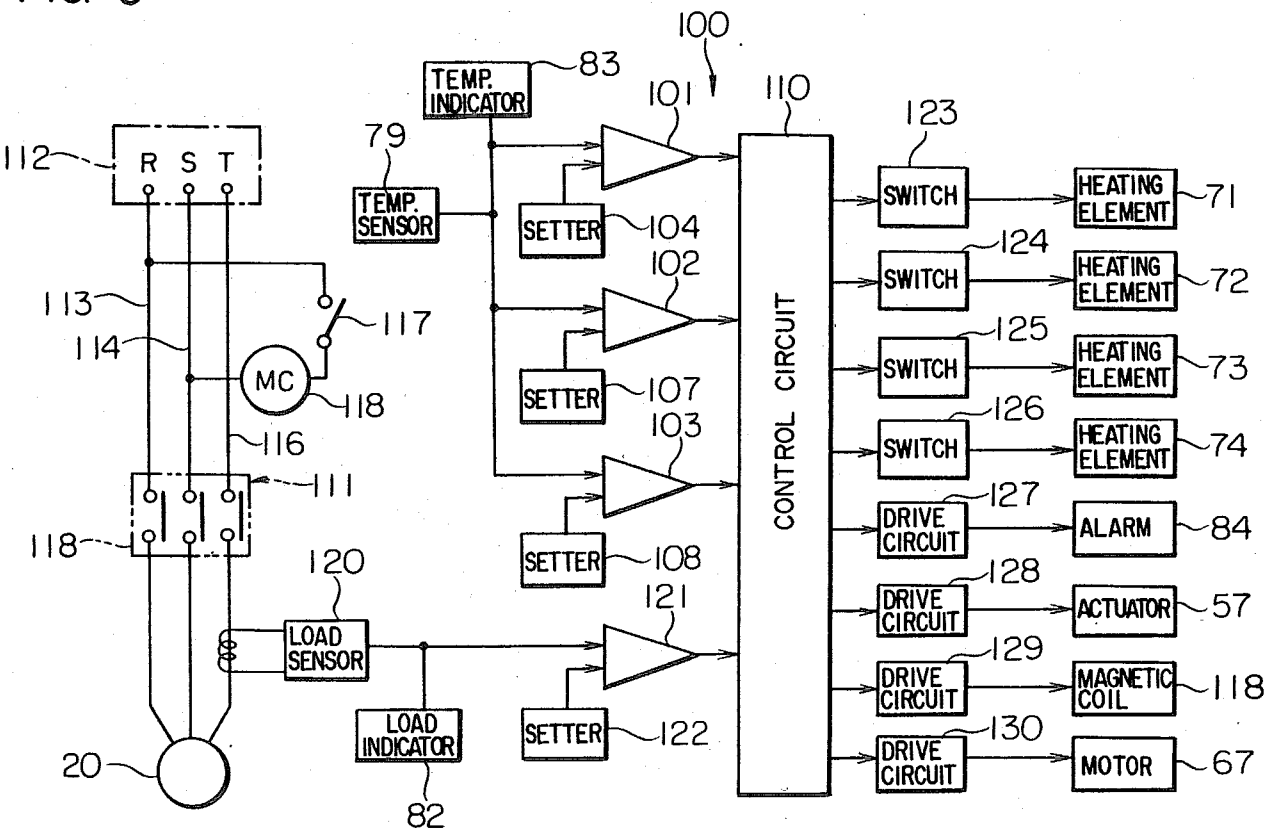
FIG. 3 is a block diagram of a control system incorporated in the apparatus shown in FIG. 1.

Referring to FIGS. 1–3, particularly to FIG. 1, there is shown apparatus for compressing and heating a material to be treated, i.e., fibrous materials such as true grasses or the like, changing the quality of the material to be treated, and solidifying the same, in accordance with an embodiment of the invention. The apparatus includes a main frame structure 1, a side frame structure 2 connected to the main frame structure 1 and a base structure 3 having mounted thereon the main and side frame structures 1 and 2. A hollow rotary shaft 4 having an axis extending substantially horizontally is rotatably supported by bearings 8 and 9 mounted at an end wall 6 of the side frame structure 2 and a bearing 11 mounted at an end wall 7 of the side frame structure 2. The rotary shaft 4 has one end 12 thereof extending from the end wall 7 of the side frame structure 2 for mounting a grooved pulley 13 for rotation together with the rotary shaft 4. A plurality of belts 17 are trained over the grooved pulley 13 and another grooved pulley 16 which is mounted on an output shaft 18 of an electric motor 20 for rotation therewith.

The end wall 6 of the side frame structure 2 is formed with an annular projection 21 fitted in an opening 22 formed at an end wall 23 of the main frame structure 1. The other end 26 of the rotary shaft 4 rotatably supported by the end wall 6 has an inner tapered surface 24. A screw 30 having a tapered end 31 fitted to the tapered surface 24 extends from the other end 26 in coaxial relation, for rotation with the rotary screw 30. The screw 30 has a threaded portion 32 extending between the tapered end 31 and a free end 33. The threaded portion 32 consists of a major diameter section 34 and a minor diameter section 36 and, further, the major diameter section 34 has a thread 37 greater in pitch than a thread 38 of the minor diameter section 36. Thus, the thread 37 of the major diameter section 34 has a greater transporting capacity than the thread 38 of the minor diameter section 36. The main frame structure 1 has the other end wall 41 spaced away from the end wall 23 to define therebetween a feeding chamber 42. An upstream end of the threaded portion 32 of the screw 30, adjacent the tapered portion 31, is located within the feeding chamber 42.

A tubular forming sleeve 45 has an end 46 fitted in an opening 47 formed at the end wall 41 of the main frame structure 1. An annular flange 48 formed at an outer peripheral surface of the forming sleeve 45 at a location adjacent the end portion 46 thereof is fastened by means of bolts, not shown, to the end wall 41. An inner peripheral surface of the forming sleeve 45 is comprised of a tapered portion 51 adjacent the feeding chamber 2 and a cylindrical portion 52. The screw 30 extends into the forming sleeve 45 in such a manner that the joint between the major and minor diameter sections 34 and 36 is positioned substantially axially midway in the tapered portion 51. The portion of the screw 30 extending into the forming sleeve 45 cooperates with the inner peripheral surface of the forming sleeve 45 to define therebetween a quality-changing chamber 55.

A hopper 56 for feeding the material to be treated to the upstream end of the threaded portion 32 of the screw 30 is mounted on the top of the main frame structure 1 in a manner to communicate with the feeding chamber 42. A pneumatic actuator 57 which is a piston-cylinder assembly is connected to a slidable shutter 58 to move the same between a fully closed position shown in FIG. 1 in which it fully closes a passageway 59 from the hopper 56 to the feeding chamber 42 and a fully open position, not shown, in which it fully opens the passageway 59.

A regulating device for regulating the flow rate of the material to be treated which is fed from the hopper 56 to the feeding chamber 42 is generally designated by the reference numeral 60 in FIG. 1. The regulating device 60 comprises a pivot 61 pivotally supported by the main frame structure 1, a valve plate 62 attached to the pivot 61 for pivotal movement therewith, a lever 63 having one end thereof securedly connected to one end of the pivot 61, a block 64 mounted to the other end of the lever 63 for angular movement relative thereto, a threaded shaft 66 threadedly engaging the block 64 and a reversible motor 67 for rotating the threaded shaft 66 in opposite directions. As the motor 67 rotates the threaded shaft 66 in one direction, the block 64 is moved away from the motor 67 along the threaded shaft 66, to thereby angularly move the lever 63 clockwise in FIG. 1 about the axis of the pivot 61. The clockwise movement of the lever 63 is transmitted through the pivot 61 to the valve plate 62, so that the valve plate 62 moves clockwise in FIG. 2, i.e., in such a direction as to decrease the cross-sectional area of the passageway 59. As the motor 67 is rotated in the reverse direction, the valve plate 62 moves in such a direction as to increase the cross-sectional area of the passageway 59.

A heating device for heating the material being treated within the quality-changing chamber 55 to keep the temperature of the material at a predetermined range during the operation of the apparatus is generally designated by the reference numeral 70 in FIGS. 1 and 2. The heating device 70 comprises a plurality of heating elements 71 and 72 of relatively high heat capacity, and a plurality of heating elements 73 and 74 of relatively low heat capacity. The heating elements 71–74 are circumferentially equidistantly spaced from each other around the outer peripheral surface of the forming sleeve 45 and extend substantially parallel to the axis of the forming sleeve 45 while being kept in contact with the outer peripheral surface thereof. The heating elements 71 and 72 are diametrically opposed to each other and the heating elements 73 and 74 are diametrically opposed to each other with respect to the forming sleeve 45. The heating elements 71–74 are kept in contact with the outer peripheral surface of the forming sleeve 45 by a cylindrical cover 76 which in turn is kept in a predetermined position by an end retainer 77 formed with a central opening. Thus, the heating device 70 is associated with the forming sleeve 45 to indirectly heat the material to be treated within the quality-changing chamber 55.

A temperature sensor 79 embedded in the forming sleeve 45 senses the temperature of the forming sleeve 45 which represents the temperature of the material within the quality-changing chamber 55, to generate a signal.

A control panel 81 is attached to the side frame structure 2 and includes a load indicator 82 for indicating a load applied to the electric motor 20 by an electric current supplied thereto in substitution for the load, a temperature indicator 83 indicating the temperature sensed by the temperature sensor 79 and an alarm 84 which may be a lamp or a buzzer for indicating that the apparatus is ready for operation, that the operation of the apparatus has finished or that the apparatus is in a dangerous condition. A control system 100 for controlling the operation of the apparatus is incorporated in the control panel 81.

The control system 100 will be described by referring to FIG. 3. The temperature sensor 79 in the forming sleeve 45 is connected to the temperature indicator 83 and to an input terminal of each of comparators 101, 102 and 103. A setter 104 connected to the input terminal of the comparator 101 sets a lower limit temperature to which the forming sleeve 45 should be heated before the apparatus is started for operation, and an upper limit value (375° C., for example) of a predetermined range of temperatures at which the material within the quality-changing chamber 55 should be heated when the apparatus is in operation. A lower limit setter 107 connected to the input terminal of the connector 102 sets a lower limit value (325° C., for example) of the aforesaid predetermined range of temperatures. A setter 108 connected to the input terminal of the comparator 103 sets a temperature (about 250° C., for example) at which the pneumatic actuator 57 and electric motor 20 should be rendered inoperative when the operation of the apparatus is finished. Output terminals of the respective comparators 101, 102 and 103 are connected to a control circuit 110. Each of the comparators 101, 102 and 103 supplies a "0" signal to the control circuit 110 when the signal from the temperature sensor 79 is equal to or lower than the temperature set by the corresponding setter 104, 107 or 108. An "1" signal is supplied to the control circuit 110 when the signal from the temperature sensor 79 exceeds the temperature set.

An electromagnetic switch 111 is provided in leads 113, 114 and 116 connecting terminals R, S and T of a power source 112 to the electric motor 20. A switch 117 for actuating the electric motor 20 and an electromagnetic coil 118 for actuating the electromagnetic switch 111 are connected in series between the leads 113 and 114 from the respective terminals R and S. A load sensor 120 for sensing a load on the electric motor 20 which represents a load on the screw 30 is associated with the lead 116 from the terminal T for sensing a change in an electric current passing through the lead 116 to generate a signal. The load sensor 120 is connected to the load indicator 82 and to an input terminal of a comparator 121. A load on the electric motor 20 represents a flow resistance pressure of the material to be treated within the quality-changing chamber 55 which is optimum for changing the quality of the material and solidifying the same as subsequently to be described and, accordingly, it is required to keep the load on the electric motor 20 constant. A load setter 122 connected to an input terminal of the comparator 121 sets the required load. An output terminal of the comparator 121 is connected to the control circuit 110. The comparator 121 supplies a "0" signal to the control circuit 110 when the signal from the load sensor 120 is less than the value set by the setter 122. When the signal from the load sensor 120 is equal to or more than the value set by the setter 122, the comparator supplies an "1" signal to the control circuit 110.

The control circuit 110 is connected to input terminals of respective switches 123–126 and to input terminals of respective drive circuits 127–130 in such a manner as to supply suitable signals to the switches 123–126 and drive circuits 127–130 in relation to the signals from the respective comparators 101–103 and 121 and the operating condition of the apparatus. Output terminals of the respective switches 123 and 124 are connected to the heating elements 71 and 72, respectively, of relatively high heat capacity. Output terminals of the respective switches 125 and 126 are connected to the heating elements 72 and 74, respectively, of relatively low heat capacity. An output terminal of the drive circuit 127 is connected to the pneumatic actuator 57; an output terminal of the drive circuit 129 is connected to the electromagnetic coil 118; and an output terminal of the drive circuit 130 is connected to the reversible motor 67.

Operation of the apparatus constructed as aforesaid will now be described. First, a power source switch, not shown, is turned on. The temperature sensor 79 senses the temperature of the forming sleeve 45 and supplies a signal indicative of the sensed temperature, to the temperature indicator 83 and to the input terminals of the respective comparators 101, 102 and 104. The control circuit 110 responds to "0", "0" and "0", "0", "0" and "1", and "0", "1" and "1" signals from the respective comparators 101, 102 and 103 and supplies "ON" signals to the switches 123–126, respectively, so as to allow an electric current to pass through all the heating elements 71–74, to thereby heat the forming sleeve 45. As the "1" signals are supplied from the respective comparators 101, 102 and 103 to the control circuit 110, i.e., when the temperature of the forming sleeve 45 exceeds the temperature set by the setter 104, the control circuit 110 supplies a signal to the drive circuit 127 to render the alarm 84 operative, informing that the apparatus is ready for operation.

Then, the switch 117 is turned on to start the electric motor 20. The load sensor 120 senses a load on the electric motor 20 and supplies a signal to the comparator 131. The comparator 131 supplies the "0" signal to the control circuit 110 when the signal from the load sensor 120 is less than the value set by the load setter 122. The control circuit 110 responds to the "1" signal from the comparator 101 and the "0" signal from the setter 121 and supplies a signal to the drive circuit 130, to render the pneumatic actuator 57 operative to move the shutter 56 to its fully open position. This allows the material in the hopper 56 to be supplied to the feeding chamber 42. The control circuit 110 responds to the "1" signals from the respective comparators 101, 102 and 103 and supplies an "OFF" signal to the switch 125, to stop the current passed to the heating element 73. However, even if the supply of the electric current to the heating element 73 is cut off, the temperature inside the quality-changing chamber 55 reaches a level (approximately 400° C., for example) which is considerably higher than the temperature set by the upper limit setter 104, because the material remaining in the quality-changing chamber 55 is relatively small in amount or is nil when the apparatus is newly put to action. The material to be treated supplied from the hopper 56 to the feeding chamber 42 is transported by the screw 30 to the quality-changing chamber 55 while being compressed. As the material is fed into the quality-changing chamber 55, the temperature of the forming sleeve 45 falls, because the material is usually stored at the normal or room temperature.

In the course of being forcibly delivered from the feeding chamber 42 through the quality-changing chamber 55 by the screw 30, the speed at which the material is delivered slows down owing to the resistance offered by the screw 30 and forming sleeve 45. During the delivery through the quality-changing chamber 55, the material is compressed so that its tissues or molecular structure is destroyed and at the same time the material becomes soft under the heating action of the forming sleeve 45 which is heated by the heating device 70. More specifically, it is believed that the lignin in the material being treated is removed therefrom by vaporization and the molecular structure of the material is destroyed by the silicates in the material. The pressurization function of the screw 30 further compresses the material being treated and compacts the same, so that the material is solidified and discharged, as a continuous formed solidity, through the opening in the end retainer 77 attached to the forming sleeve 45.

During the aforementioned quality-changing and solidification the comparator 121 compares the signal from the load sensor 120 generated by sensing a load on the electric motor 20 with the value set by the load setter 122 and supplies to the control circuit 110 a signal indicative of the result of comparison. When the signal from the comparator 121 shows that the signal from the load sensor 120 is less than the value set by the setter 122, the control circuit 110 supplies a signal to the drive circuit 130 to rotate the reversible moto 67 of the regulating device 60 in the normal direction, so as to angularly move the valve plate 62, to thereby increase the amount of the material to be treated supplied from the hopper 56 to the feeding chamber 42. The increase in the amount of the material supplied to the feeding chamber 42 continues until the flowing pressure of the material being treated which flows through the quality-changing chamber 55 toward the opening in the retainer 77 becomes equal to the value of the load set by the load setter 122. Conversely, when the signal supplied by the comparator 121 to the control circuit 110 indicates that the value sensed by the load sensor 120 is higher than the value set by the load setter 122, the control circuit 110 supplies a signal to the drive circuit 130 to rotate the reversible motor 67 in the reverse direction, thereby angularly moving the valve plate 62 in a direction in which the amount of the material supplied from the hopper 56 to the feeding chamber 42 decreases and the flowing pressure of the material transported through the quality-changing chamber 55 is reduced. Thus, the value of the load on the electric motor 20 is controlled such that it is maintained at the level set by the load setter 122. Since the present embodiment deals with the variation or fluctuation in the load by a single comparator, there may in general be anxiety about the problem of occurrence of hunting. To cope with this, however, the signal from comparator 121 may intermittently be sent to the control cicuit 110 to operate the reversible motor 67 intermittently by a constant amount, or, as is well known, two comparators may be provided to permit the reversible motor 67 to be operated between upper and lower limit values.

During the operation of the apparatus, the material to be treated is continuously fed by the screw 30 into the quality-changing chamber 55 while being compressed and, therefore, the temperature of the feeding sleeve 45 do not fall suddenly, because also of the heat generating action due to the compression. However, when the material supplied by the hopper 56 to the feeding chamber 42 is relatively low in temperature or when the flow rate of the material flowing through the quality-changing chamber 55 rises, the temperature of the forming sleeve 45 falls. As the temperature of the forming sleeve 45 falls equal to or below the level set by the lower limit setter 107, the control circuit 110 responds to the "0", "0" and "1" signals from the respective comparators 101, 102 and 103 and supplies an "ON" signal to the switch 125, thereby passing an electric current to the heating element 73 to heat the forming sleeve 45. Conversely, as the temperature of the forming sleeve 45 exceeds the temperature set by the upper limit setter 104 during the operation of the apparatus, the control circuit 110 responds to the "1" signals from the respective comparators 101, 102 and 103 and supplies an "OFF" signal to the switch 125, thereby discontinuing the supply of current to the heating element 73. Thus, the temperature of the forming sleeve 45, i.e., the temperature of the material being treated within the quality-changing chamber 55 is maintained at all times during the operation of the apparatus in the range between the upper and lower limit values (between 325° C. and 475° C., for example) respectively set by the upper limit setter 104 and the lower limit setter 107. Incidentally, it will be needless to say that it can be modified into any desired forms in accordance with the set values in the respective setters 104 and 107 and with the circuit arrangement of the control circuit 110, in what manner the heating elements 71 to 74 are controlled in response to the temperature sensed by the temperature sensor 79.

When it is desired to render the apparatus inoperative, the aforesaid power source switch is turned off. In response to the "OFF" signal from the power source switch, the control circuit 110 respectively supplies "OFF" signals to the switches 123–126, discontinuing the supply of current to all the heating elements 71–74. As the rotation of the screw 30 is continued to successively feed the material to the quality-changing chamber 55, the temperature of the forming sleeve 45 decreases. As the temperature of the forming sleeve 45 falls to about 250° C., the material solidified and discharged through the opening in the retainer 77 is discharged in particulate form. As the comparator 103 supplies to the control circuit 110 a signal indicating that the temperature of the forming sleeve 45 sensed by the temperature sensor 79 has fallen below the value set by the setter 108, the control circuit 110 responds to the "OFF" signal from the power source switch and the "0" signals from the respective comparators 101, 102 and 103 and supplies an "OFF" signal to the drive circuit 128 to render the pneumatic actuator 57 operative, thereby moving the shutter 62 to the fully closed position. At the same time, the control circuit 110 supplies a signal to the drive circuit 129 to render the electromagnetic coil 118 operative to cause the electromagnetic switch 111 to be opened, thereby automatically shutting down the electric motor 20. When the electric motor 20 is automatically shut down, the material remaining in the quality-changing chamber 55 is not in the form of solidity but in particulate from. Thus, when the electric motor 20 is restarted to render the apparatus operative again, no trouble is caused to occur by the material remaining in the quality-changing chamber 55.

From the foregoing description, it will be appreciated that the apparatus is operated under such a condition that the heating temperature of the material being treated within the quality changing chamber 55 and the load on the electric motor 20 are controlled in ranges optimum for the change in quality and solidification. More specifically, when the apparatus is started for operation, the temperature of the forming sleeve 45 is raised to a level of approximately 400° C., to promote the softening of the material fed into the quality-changing chamber 55, to thereby facilitate the forming and solidification within the quality-changing chamber 55. In this manner, the compressed and compacted degree required for the quality-changing and solidification which are insufficient within the quality-changing chamber 55 when the apparatus is started for operation can be ensured and, therefore, the apparatus is capable of creating in a short period of time a condition in which the material can be changed into a quality-changed and solidified product which would be acceptable by the customers. During the continuous operation of the apparatus, the temperature at which the forming sleeve 45 is heated is controlled to be in the range from 325° C. to 375° C. This temperature range best serves the purpose of softening the material to be treated. When the operation is finished or completed, the electric motor 20 automatically stops rotating after the temperature of the forming sleeves 45 has fallen below 250° C. This prevents the material in a solidified state from remaining in the quality-changing chamber 55, thereby facilitating restarting operation of the apparatus.

To smoothly perform the quality-changing and solidification over a prolonged period of time, it is as much necessary to keep constant the load applied to the electric motor 20 as to control the heating temperature as described hereinabove. This is because the load applied to the electric motor 20 has profound effects on the compressed and compacted degree of the material within the quality-changing chamber 55 and on the flow resistance pressure of the quality-changed solidity. The regulating device 60 is in response to the signal from the load sensor 120 for detecting changes in the load applied to the electric motor 20 to control the amount of material to be treated which is supplied from the hopper 56 to the feeding chamber 42, and consequently from the feeding chamber 42 to the quality-changing chamber 55. That is, the regulating device 60 controls, based on the value of a load applied to the electric motor 20, the amount of the material fed into the quality-changing chamber 55 in a manner to optimize the compressed and compacted degree and the quality-changing and solidification of the material within the quality-changing chamber 55. Thus, the apparatus is capable of continuously performing over a prolonged period of time the quality-changing and solidification of the material being treated in a stable condition to thereby process the material into formed products of high quality, while preventing the occurrence of accidents involving the shutdown of the apparatus due to excessive compression and solidification of the material and obviating the problem that the product might be unacceptable due to insufficient compression and solidification of the material.

The embodiment shown in FIGS. 1-3 has been described as setting a temperature range (between 325° C. and 375° C., for example) necessary for the continuous operation of the apparatus by using two sets of setters and comparators 101 and 104 and 102 and 107. However, the invention is not limited to this specific form of the embodiment. A further setter for setting a required further temperature (350° C., for example) and a further comparator for comparing a signal generated by the further setter with a signal generated by the temperature sensor and generating "0" and "1" signals may be used to turn on and off the heating element 74 by the "0" and "1" signals. Alternatively, one more set of setter and comparator may be additionally used to control the above-described temperature (approximately 400° C., for example) prevailing before the operation is started.

In the apparatus according to the invention, it is not essential that both the temperature sensor 79 and the load sensor 120 be provided. Either one of the two sensors may be used to control the operation of the apparatus based on signals generated by the one sensor.

Figure 4:
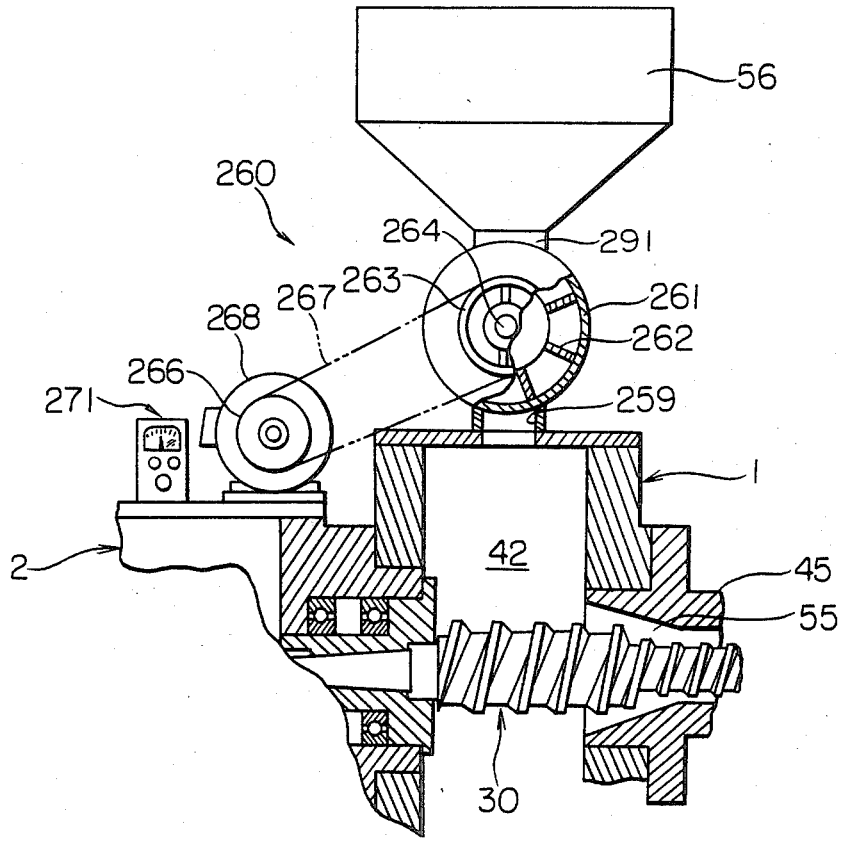
FIG. 4 is a fragmentaly cross-sectional view of an apparatus in accordance with another embodiment of the invention.

FIG. 4 shows an apparatus in accordance with another embodiment of the invention, in which like reference numerals are used to designate parts and component similar to those shown in FIGS. 1 and 2, and the description of such parts and components will therefore be omitted to avoid duplication or repetition. The embodiment shown in FIG. 4 comprises a regulating device generally designated by the reference numeral 260 in substitution for the regulating device 60 shown in FIGS. 1 and 2. The regulating device 260 comprises a cylindrical casing 261 provided in a tubular member 291 defining a passageway 259 from the hopper 56 to the feeding chamber 42, and a rotary valve assembly 262 rotatably supported in the casing 261 by a shaft 264. A belt 267 is trained over a pulley 263 mounted on the shaft 264 of the rotary valve assembly 262 for rotation therewith, and a pulley 266 mounted on an output shaft of a motor 268 for rotation therewith. An inverter 271 which is connected to the motor 268, and the load sensor 120 for the electric motor 20 shown in FIGS. 1 and 3 are connected together by the control circuit 110 also shown in FIGS. 1 and 3.

Operation of the embodiment shown in FIG. 4 constructed as described hereinabove will be described by referring to the block diagram of the control system 100 shown in FIG. 3. In the control system 100, the drive circuit 130 and the motor 67 are replaced by the inverter 271 and the motor 268, respectively. The load sensor 120 detects a load applied to the electric motor 20 which depends upon the compression and heating, quality-changing, and solidifying of the material to be treated within the quality-changing chamber 55 to which the material is fed through the regulating device 260 and the feeding chamber 42. A signal generated by the sensor 120 is supplied to the comparator 121 which supplies to the control circuit 110 an output signal indicating whether the signal from the sensor 120 is higher or lower than the value set by the load setter 122, and the control circuit 110 supplies an output signal to the inverter 271 based on the value of the signal from the comparator 121. In response to the signal from the control circuit 110, the inverter 271 controls the rotational speed of the motor 268, to thereby automatically regulate the rotational speed of the rotary valve assembly 262 in such a manner that the value of the load set by the load setter 122 becomes equal to the signal from the load sensor 120. Thus, the amount of material supplied from the hopper 56 to the feeding chamber 42 is regulated. In the embodiment shown in FIG. 4, the material to be treated is supplied from the hopper 56 to the feeding chamber 42 by the rotation of the rotary valve assembly 262. This ensures that the material to be treated is smoothly supplied from the hopper 56 in a stable condition to the feeding chamber 42 by eliminating the risk that the supply of the material might otherwise be blocked due to its jamming inside the hopper 56.

Figure 5:
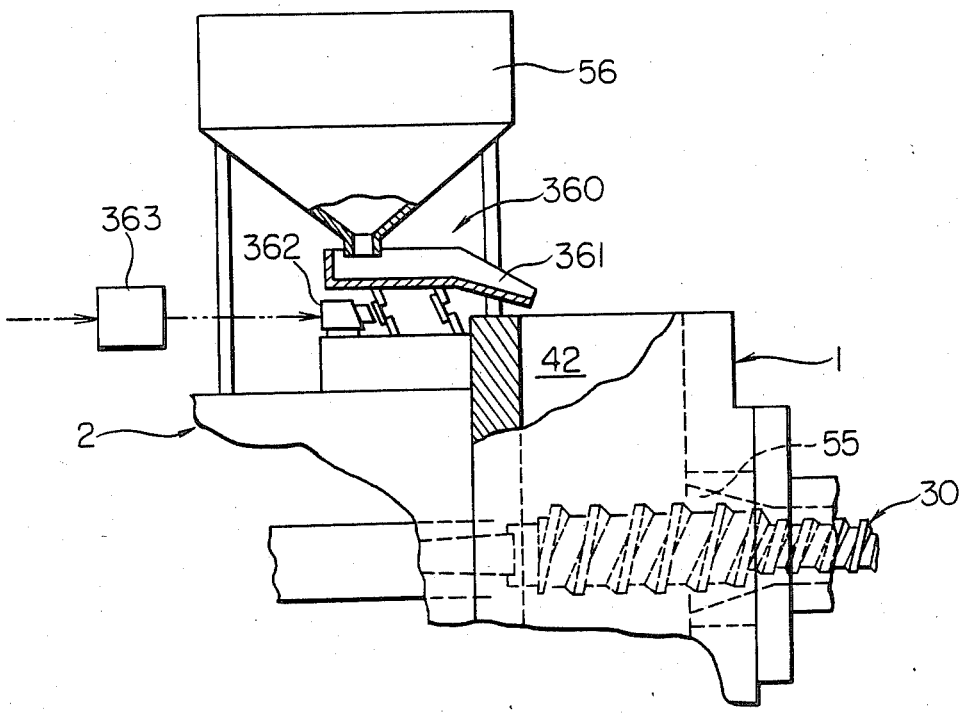
FIG. 5 is a fragmental, partially broken-away, side elevational view showing an apparatus in accordance with still another embodiment of the invention.

FIG. 5 shows an apparatus in accordance with still another embodiment of the invention, in which like reference numerals are used to designate parts and components similar to those shown in FIGS. 1–3, and the description of such similar parts or components will therefore be omitted for simplification. In the embodiment shown in FIG. 5, the regulating device 60 shown in FIGS. 1 and 2 is replaced by a regulating device 360 which comprises an oscillatory feeder 361 interposed between the hopper 56 and feeding chamber 42, a vibrator 362 for causing the oscillatory feeder 361 to vibrate, and a controller 363 responsive to a signal from the control circuit 110 shown in FIG. 3 to control the number or amplitude of vibrations of the oscillatory feeder 361 caused to vibrate by the vibrator 362. The vibrator 362 may be an electromagnet, for example.

In the embodiment shown in FIG. 5, the controller 363 is responsive to a signal value supplied from the comparator 121 to the control circuit 110 based on a signal generated by the load sensor 120 shown in FIG. 3, to control the voltage or current supplied to the vibrator 362, to thereby regulate the number or amplitude of vibrations of the oscillatory feeder 361. Thus, the amount of material supplied from the hopper 56 to the feeding chamber 42 is regulated. The embodiment shown in FIG. 5 enables the amount of material supplied to the feeding chamber 42 to be regulated with a high degree of precision.

From the foregoing description, it will be appreciated that in the apparatus according to the invention, the load applied to the electric motor and/or the temperature of material being treated inside the quality-changing chamber which varies depending on the compressed degree of the material to be treated fed to the quality-changing chamber, the softened degree of the material, the quality-changed degree of the material, and the density of the solidified material are sensed, and the amount of material supplied to the feeding chamber and/or the heat capacity of the heating device are or is controlled based on signals generated as the result of sensing the change in the load and/or the temperature of the material, thereby optimizing the amount of material supplied to the feeding chamber and/or the heat capacity of the heating device. The invention has succeeded in obviating many problems. They include excessive compression and solidification of fibrous material making it inevitable to shut down the apparatus, explosion of non-combusted gas produced in the quality-changing chamber due to excessive compression of fibrous material causing the formed solidity to be blown out of the apparatus, and production of unsatisfactory products due to insufficient compression and solidification of fibrous materials. Thus, the apparatus according to the invention is capable of continuously performing over a prolonged period of time the quality-changing and solidification of the fibrous materials in a stable condition, to process the fibrous materials into formed products of high quality.

What is claimed is:

1. An apparatus for compressing and heating a material to be treated, i.e., fibrous materials of plants, changing the quality of the material, and solidifying the same, said apparatus comprising:

a rotatable screw having an upstream and a downstream end;

tabular forming means disposed around said screw and cooperating with the same to define therebetween a quality-changing chamber;

feeding means for feeding the material to be treated to the upstream end of said screw;

heating means having a variable heating capacity and associated with said tubular forming means for heating the material to be treated within said quality-changing chamber so as to maintain the temperature of the material within said quality-changing chamber at a predetermined value within a given range during the operation of the apparatus;

drive means drivingly connected to said screw to rotate the same to deliver the material fed from said feeding means, to said quality-changing chamber while compressing the material, to cause the material to be delivered through said quality-changing chamber toward the downstream end of said screw while the material is heated by said heating means, to thereby allow the material to be gradually changed in quality and solidified due to the compression by said screw and the heating by said heating means during the passage of the material through said quality-changing chamber;

sensor means for sensing a parameter varying depending upon the temperature of the material being treated within said quality-changing chamber to generate a signal;

control means responsive to the signal from said sensor means, said control means comprising setter means for setting said given rnage, comparator means connected to said sensor means and said setter means for comparing the signal from said sensor means with the range set by said setter means to generate a signal, and control circuit means responsive to the signal from said comparator means to generate an operation signal;

means operative in response to the operation signal from said control means to adjust the heat capacity of said heating means.

2. An apparatus as claimed in claim 1, wherein said setter means comprises an upper limit setter for setting an upper limit value of said range, a lower limit setter for setting a lower limit values of said range, a first comparator connected to said upper limit setter for comparing the signal from said sensor means with said upper limit value to generate a signal, and a second comparator connected to said lower limit setter for comparing the signal from said sensor means with said lower limit value to generate a signal, said control circuit means being responsive to the signals from the respective first and second comparators to generate the operation signal.

3. An apparatus as claimed in claim 1, including:

second sensor means for sensing a parameter varying depending upon a load applied to said screw to generate a signal;

said control means being responsive to the signal from said second sensor means to generate a second operation signal; and second regulating means operative in response to the second operation signal from said control means for regulating the flow rate of the material to be treated which is fed to the upstream end of said screw.

4. An apparatus as claimed in claim 3, wherein said drive means comprises an electric motor, and wherein said second sensor means senses a load applied to said electric motor.

5. An apparatus as claimed in claim 4, wherein said control means comprises second setter means for setting a predetermined load value, second comparator means connected to said second sensor means and said second setter means for comparing the signal from said second sensor means with said predetermined load value, and said control circuit means being connected to said second comparator means and responsive to the signal from said second setter means to generate the second operation signal.

6. An apparatus as claimed in claim 5, wherein said second regulating means comprises a plate member movable so as to vary a cross-sectional area of a passageway from said feeding means to the upstream end of said screw, and a drive unit responsive to the second operation signal from said control circuit means to move said plate member.

7. An apparatus as claimed in claim 5, wherein said second regulating means comprises a rotary valve provided in a passageway extending from said feeding means to the upstream end of said screw, and means responsive to the second operation signal from said control circuit means to regulate the rotational speed of said rotary valve.

8. An apparatus as claimed in claim 5, wherein said second regulating means comprises an oscillatory feeder disposed between said feeding means and the upstream end of said screw for feeding the material to be treated from said feeding means to the upstream end of said screw, means for causing said oscillatory feeder to vibrate, and means responsive to the second operation signal from said control circuit means to adjust one of the number and amplitude of vibrations of said oscillatory feeder applied by said vibrator means.

9. An apparatus as claimed in claim 5, wherein said heating means comprises a plurality of heating elements which are independent of each other, some of said heating elements having a heat capacity different from that of the remaining heating elements.

10. An apparatus for compressing and heating a material to be treated, i.e., fibrous materials of plants, changing the quality of the material, and solidfying the same, said apparatus comprising:

a rotatable screw having an upstream and a downstream end;

tubular forming means disposed around said screw and cooperating with the same to define therebetween a quality-changing chamber;

feeding means for feeding the material to be treated to the upstream end of said screw;

heating means associated with said tubular forming means to heat the material to be treated within said quality-changing chamber so as to maintain the temperature of the material within said quality-changing chamber at a predetermined value during the operation of the apparatus;

electric motor drive means drivingly connected to said screw to rotate the same to deliver the material fed from said feeding means, to said quality-changing chamber while compressing the material, to cause the material to be delivered through said quality-changing chamber toward the downstream end of said screw while the material is heated by said heating means, to thereby allow the material to be gradually changed in quality and solidified due to the compression by said screw and the heating by said heating means during the passage of the material through said quality-chaning chamber;

sensor means for sensing a load applied to said electric motor, said load varying in dependence on the load applied to said screw, to generate a signal;

control means responsive to the signal from said sensor means, said control means comprising setter means for setting a predetermined load value, comparator means connected to said sensor means and said setter means for comparing the load value set by said setter means with a signal from said sensor means to generate a signal, and control circuit means connected to said comparator means and responsive to the signal from said comparator means to generate an operation signal, regulating means operative in response to the operation signal from said control means to regulate the flow rate of the material to be treated fed from said feeding means to the upstream end of said screw;

said regulating means comprising an oscillatory feeder disposed between said feeding means and the upstream end of said screw for feeding the material to be treated from said feeding means to the upstream end of said screw, means for causing said oscillatory feeder to vibrate, and controller means responsive to the operation signal from said control circuit means to adjust one of the number and amplitude of vibrations of said oscillatory feeder applied by said vibrator means.

11. An apparatus for compressing and heating a material to be treated, i.e., fibrous materials of plants, changing the quality of the material, and solidifying the same, said apparatus comprising:

a rotaatable screw having an upstream and a downstream end;

tubular forming means disposed around said screw and cooperating with the same to define therebetween a quality-changing chamber;

feeding means for feeding the material to be treated to the upstream end of said screw;

heating means associated with said tubular forming means to heat the material to be treated within said quality-changing chamber so as to maintain the temperature of the material within said quality-changing chamber so as to maintain the temperature of the material within said quality-changing chamber at a predetermined value during the operation of the apparatus, said heating means comprising a plurality of heating elements which are independent of each other, some of said heating elements having a heat capacity different from that of the remaining heating elements;

electric motor drive means drivingly connected to said screw to rotate the same to deliver the material fed from said feeding means, to said quality-changing chamber while compressing the material, to cause the material to be delivered through said quality-changing chamber toward the downstream end of said screw while the material is heated by said heating means, to thereby allow the material to be gradually changed in quality and solidifed due to the compression by said screw and the heating by said heating means during the passage of the material through said quality-change chamber;

sensor means for sensing a load applied to said electric motor, said load varying in dependence on the load applied to said screw, to generate a signal;

control means responsive to the signal from said sensor means, said control means comprising setter means for setting a predetermined load value, comparator means connected to said sensor means and said setter means for comparing the load value set by said setter means with a signal from said sensor means to generate a signal, and control circuit means connected to said comparator means and responsive to the signal from said comparator means to generate an operation signal;

regulating means operative in response to the operation signal from said control means to regulate the flow rate of the material to be treated fed from said feeding means to the upstream end of said screw.

* * * * *

UNITED STATES PATENT AND TRADEMARK OFFICE

CERTIFICATE OF CORRECTION

PATENT NO. : 4,700,622

DATED : October 20, 1987

INVENTOR(S) : Tosihiko Satake

It is certified that error appears in the above-identified patent and that said Letters Patent is hereby corrected as shown below:

Column claim 1, line delete "tabular" and substitute therefor --tubular--, line 42, delete "rnage" and substitute therefor --range--.

Column 14, claim 10, line 12, delete chaning" and substitute therefor --changing--.

Column 14, claim 11, line delete "rotaatable" and substitute therefor --rotatable--.

Signed and Sealed this

First Day of March, 1988

*Attest:*

DONALD J. QUIGG

*Attesting Officer*

*Commissioner of Patents and Trademarks*